US009102160B2

(12) United States Patent
Yamada

(10) Patent No.: US 9,102,160 B2
(45) Date of Patent: Aug. 11, 2015

(54) INK FILLING APPARATUS AND INK FILLING METHOD

(71) Applicant: CANON KABUSHIKI KAISHA, Tokyo (JP)

(72) Inventor: Ryota Yamada, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/458,109

(22) Filed: Aug. 12, 2014

(65) Prior Publication Data

US 2015/0062259 A1 Mar. 5, 2015

(30) Foreign Application Priority Data

Sep. 2, 2013 (JP) ..... 2013-181555

(51) Int. Cl.
*B41J 2/175* (2006.01)
*B41J 29/377* (2006.01)

(52) U.S. Cl.
CPC ..... *B41J 2/17506* (2013.01); *B41J 29/377* (2013.01)

(58) Field of Classification Search
USPC ..... 347/86, 87, 85, 84
See application file for complete search history.

(56) References Cited

U.S. PATENT DOCUMENTS

| | | | | |
|---|---|---|---|---|
| 6,007,193 | A * | 12/1999 | Kashimura et al. | 347/92 |
| 6,058,984 | A * | 5/2000 | Sato | 141/7 |
| 2009/0085989 | A1 * | 4/2009 | Takata | 347/85 |
| 2012/0216491 | A1 | 8/2012 | Yoneda et al. | 53/452 |
| 2012/0227861 | A1 | 9/2012 | Shiba et al. | 141/5 |

FOREIGN PATENT DOCUMENTS

JP 3287791 6/2002

OTHER PUBLICATIONS

U.S. Appl. No. 14/510,751, filed Oct. 9, 2014.

* cited by examiner

*Primary Examiner* — Henok Legesse
(74) *Attorney, Agent, or Firm* — Fitzpatrick, Cella, Harper & Scinto

(57) ABSTRACT

When ink remains in a space that communicates with an ink storage chamber so as to be set under reduced pressure together with the ink storage chamber, the pressure in the ink storage chamber can still be efficiently reduced to a target pressure level. A liquid spray device sprays liquid toward a pipe extended between a negative-pressure generation member storage chamber and a valve in order to cool down ink that is present inside the pipe.

12 Claims, 6 Drawing Sheets

INK FILLING APPARATUS AND INK FILLING METHOD

BACKGROUND OF THE INVENTION

1. Field of the Invention

The present invention relates to an ink filling apparatus and an ink filling method employed for feeding ink to fill an ink storage chamber where a negative-pressure generation member is arranged.

2. Description of the Related Art

An example ink tank used to supply ink to an inkjet print head includes an ink storage chamber (a first chamber) where a negative-pressure generation member is arranged and an ink storage chamber (a second chamber) where a negative-pressure generation member is not arranged. The first chamber includes an ink supply port and an air communication port, and the internally provided negative-pressure generation member absorbs and holds ink to apply negative pressure to ink. The second chamber communicates only with the first chamber to substantially define closed space, in which directly ink is to be stored. For this type of ink tank, an ink filling method (reduced-pressure filling method) has been proposed whereby pressure in an ink tank is reduced for supplying ink to fill the ink tank (Japanese Patent No. 3287791).

According to the method described in Japanese Patent No. 3287791, the first chamber and the second chamber are maintained under predetermined reduced pressure, and supply of ink is begun in the order of the second chamber and the first chamber.

SUMMARY OF THE INVENTION

In the first aspect of the present invention, there is provided an ink filling apparatus, for supplying ink to fill an ink tank that includes an ink storage chamber having a negative-pressure generation member, an ink supply port used to supply ink in the ink storage chamber to an outside, and a communication port through which the ink storage chamber communicates with the atmosphere, comprising:

- a pressure reduction unit configured to reduce pressure in the ink storage chamber through the communication port;
- a filling unit configured to supply ink via the ink supply port to fill the ink storage chamber; and
- a cooling unit configured to cool down the ink present in a space that communicates with the ink storage chamber so that pressure in the space is to be reduced by the pressure reduction unit together with the ink storage chamber.

In the second aspect of the present invention, there is provided an ink filling method, for supplying ink to fill an ink tank that includes an ink storage chamber having a negative-pressure generation member, an ink supply port used to supply ink in the ink storage chamber to an outside, and a communication port through which the ink storage chamber communicates with the atmosphere, comprising:

- a pressure reduction step of reducing pressure in the ink storage chamber through the communication port;
- a filling step of supplying ink from the ink supply port to the ink storage chamber after the pressure in the ink storage chamber has been reduced at the pressure reduction step;
- a cooling step of performing cooling, before the pressure reduction step is to be performed, for ink that is present in a space that communicates with the ink storage chamber so that pressure in the space is to be reduced at the pressure reduction step together with the ink storage chamber.

Further features of the present invention will become apparent from the following description of exemplary embodiments (with reference to the attached drawings).

DESCRIPTION OF THE EMBODIMENTS

Figure 1:
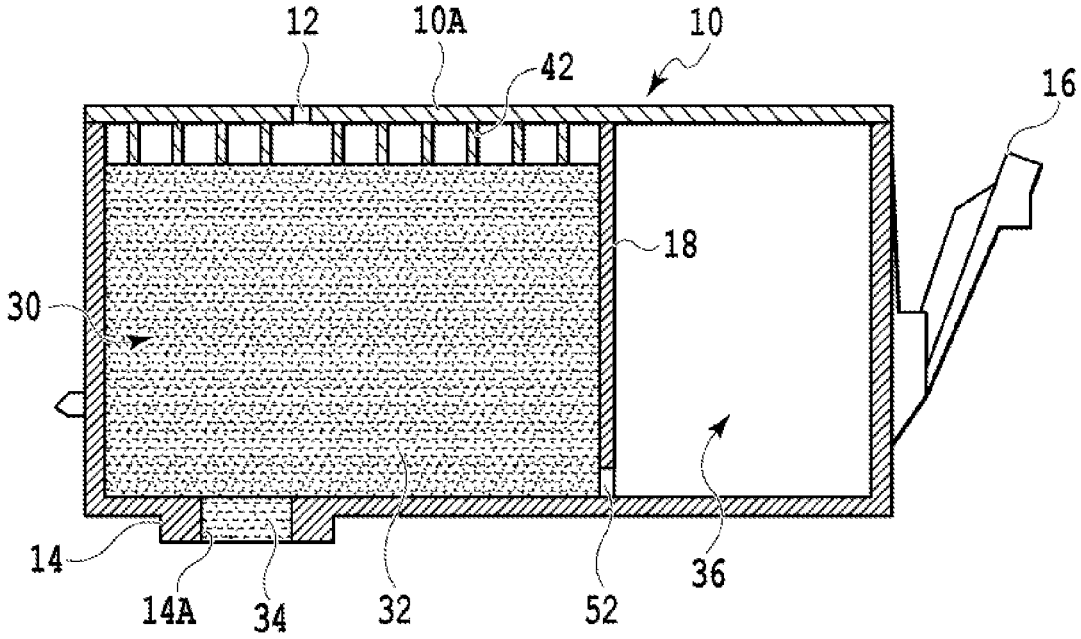
FIG. 1 is a cross-sectional view of an ink tank, for which the present invention can be applied.

The important matter for quality control for an ink tank is reduction of the volume of air bubble that remains in the individual ink storage chambers after filling of the ink tank is completed. This is necessary because of prevention of the leakage of ink when a user opens the ink tank. The currently employed ink filling methods are: a pressurizing filling method for filling an ink tank under the normal pressure by pressurizing ink, and a reduced-pressure filling method, as described in Japanese Patent No. 3287791, whereby the pressure in the ink tank is reduced and thereafter, the ink tank is filled.

According to the pressurizing filling method, filling of the ink tank is performed while air present in the ink tank is expelled by pressurizing ink. Therefore, when the ink filling speed is increased, air might be entrained in ink, and when such entrainment has occurred, the volume of air bubble in the ink storage chamber where feeding of ink has been performed might be increased. Therefore, there is a limitation to the filling speed employed for the pressurizing filling method, and a period required for ink filling is extended.

In contrast, according to the reduced-pressure filling method, since the ink filling process is initiated after the air is discharged from the ink tank, the volume of bubble remaining in the ink storage chamber can be reduced even when the filling speed is increased. Generally, when the pressure in the ink tank is reduced by performing the pressure reduction process, the volume of air bubble remaining in the ink storage chamber after the ink filling process has been completed is also reduced. That is, control of the pressure during the pressure reduction process is important for the reduced-pressure filling method, so that the volume of air bubble will be equal to or smaller than a value with which the leakage of ink can be prevented.

In a case wherein the reduced-pressure filling method described in Japanese Patent No. 3287791 is employed to supply ink to sequentially fill a plurality of ink tanks, it is conceivable that ink remains in a space that communicates with the ink storage chambers (e.g., one part of a pipe) so as to be set under reduced pressure together with the ink storage chamber. If reduction of the pressure of the ink storage chamber is performed while ink remains in such a space, the pressure in the ink storage chamber will reach the saturation vapor pressure level, and cause ink remaining in the space to boil. In a case wherein ink boiling has occurred, it is difficult to reduce the pressure in the ink storage chamber, because a large amount of water vapor is contained in the air to be discharged from the ink storage chamber. Therefore, in a case wherein, for example, the target pressure required for supplying ink to the ink storage chamber is lower than the saturation vapor pressure, a pressure reduction period would be extended.

The present invention provides an ink filling apparatus and an ink filling method whereby the pressure in an ink storage chamber can be efficiently reduced to a target pressure level even when ink remains in the space that communicates with the ink storage chamber so as to be set under reduced pressure together with the ink storage chamber.

The embodiments of the present invention will now be described based on drawings.

First Embodiment

First, the internal structure of an ink tank 10 according to a first embodiment of the present invention will be described while referring to FIG. 1.

The ink tank 10 includes a negative-pressure generation member storage chamber 30 and an ink storage chamber that are defined by a partition wall 18. The negative-pressure generation member storage chamber (hereinafter also referred to as a "first storage chamber") 30 communicates with the atmosphere through a communication port 12 that is formed on the upper face of the first storage chamber 30. An ink supply port 14A is formed in the lower portion of the first storage chamber 30, and an absorber 32 serving as a negative-pressure generation member is stored inside the first storage chamber 30. A pressure contact member 34, for which the capillary force and the physical strength are greater in magnitude than those of the absorber 32, is arranged in an ink supply cylinder 14 forming the ink supply port 14A, and the pressure contact member 34 and the absorber 32 are pressed against each other. The ink storage chamber (hereinafter also referred to as a "second storage chamber") 36 communicates only with the first storage chamber 30 via a communication port 52 to substantially provide closed space.

A plurality of ribs 42 are formed on an upper wall 10A of the ink tank 10 where the first storage chamber 30 is arranged, and are projected inside the first storage chamber 30 and contact the absorber 32. An elastically deformable lever member 16 is integrally formed on the outer wall of the ink tank 10, and an engagement protrusion is formed in the middle of the lever member 16. When the engagement protrusion engages one part of an ink tank mounting section, the ink tank 10 is detachably mounted to the ink tank mounting section.

Basic Structure of Ink Filling Apparatus

The basic structure of an ink filling apparatus for supplying ink to fill the above described ink tank 10 will now be described based on FIG. 2.

Figure 2:
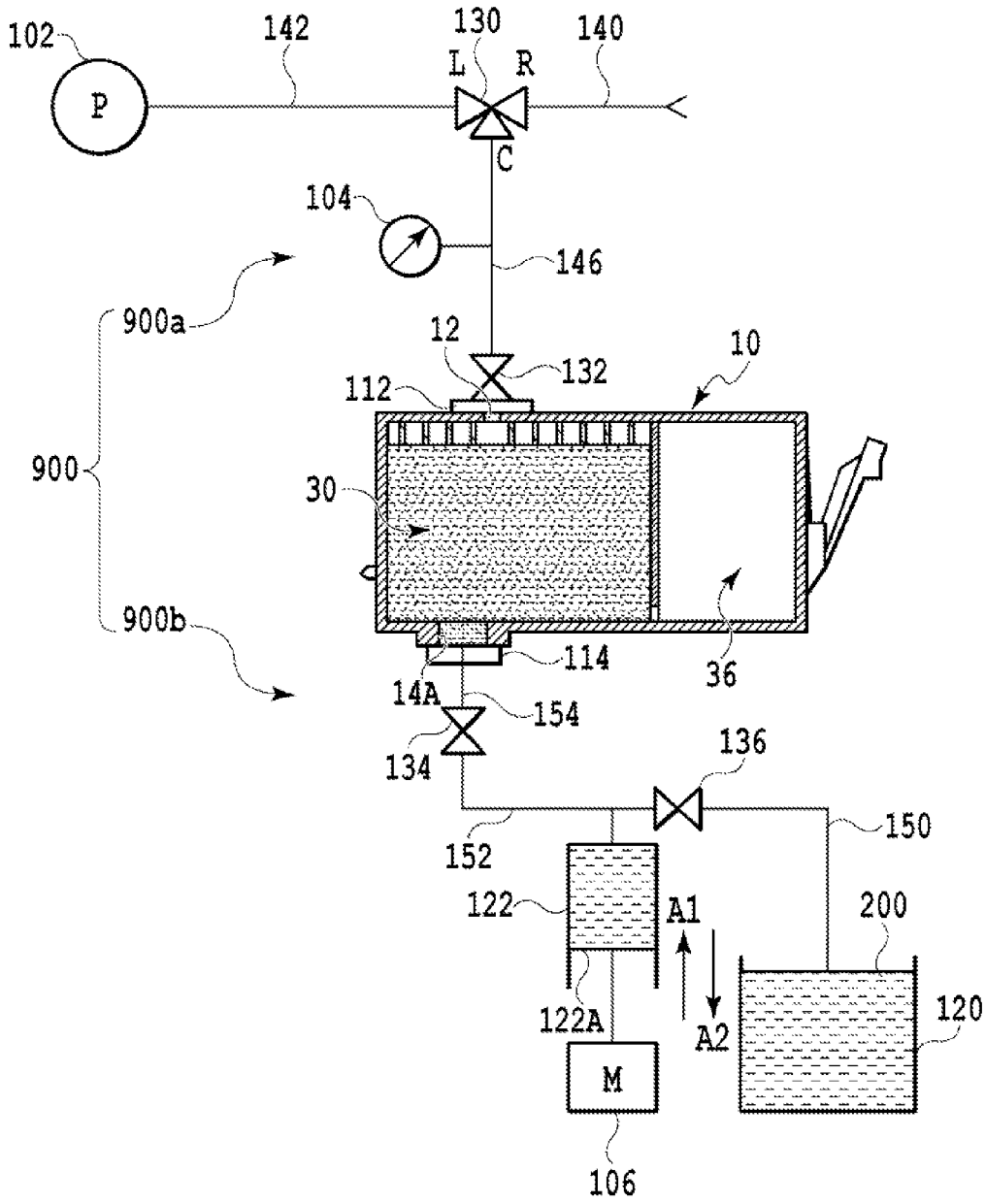
FIG. 2 is a schematic diagram for explaining the basic arrangement of an ink filling apparatus according to the present invention.

An ink filling apparatus 900 in FIG. 2 includes a pressure reduction unit 900*a* and a filling unit 900*b*. The pressure reduction unit 900*a* is connected to the communication port 12, located on the upper face of the ink tank 10, and reduces the pressure in the ink tank 10, while the filling unit 900*b* is connected to the ink supply port 14A located at the lower portion of the ink tank 10 to supply ink 200 to the ink tank 10. For the pressure reduction unit 900*a*, a vacuum pump 102 serving as a negative-pressure generation source, a barometer 104, a three-way valve 130, a valve 132 and a contact member 112 are connected together by pipes 140, 142 and 146. The contact member 112 is closely attached to the opening face of the communication port 12 to permit communication between the communication port 12 and the valve 132. For the filling unit 900*b*, an ink reservoir 120, a syringe 122, valves 134 and 136 and a contact member 114 are connected together by pipes 150, 152 and 154. The contact member 114 is closely attached to the opening face of the ink supply port 14A to permit communication between the ink supply port 14A and the valve 134. One end of the pipe 140 and the ink reservoir 120 are open to the atmosphere.

For performing the ink filling process, first, the ink tank 10 is mounted to a fixture (not shown), and is positioned so that the ink supply port 14A is located at the bottom. Thereafter, the contact member 112 is closely attached to the opening face of the communication port 12, while the contact member 114 is closely attached to the opening face of the ink supply port 14A.

Sequentially, the pressure in the ink tank 10 is reduced by the pressure reduction unit 900*a* (pressure reduction process). It is supposed that the vacuum pump 102 is always driven for pressure reduction. The reduction of the pressure in the ink tank 10 is initiated by opening the passage between ports L and C of the three-way valve 130 and also by opening the valve 132, and the atmospheric pressure in the ink tank 10 is gradually reduced. The barometer 104 is employed to determine whether the air pressure in the ink tank 10 has reached a predetermined pressure level (in this embodiment, 2.0 kPa). When the predetermined pressure level is reached, the valve 132 is closed to halt the reduction of the pressure in the ink tank 10.

Next, the filling unit 900*b* is employed for supplying ink to the ink tank 10 (filling process). First, the valve 134 is open, and a motor 106 is driven to move forward a piston 122A of the syringe 122 in a direction indicated by an arrow A1. As a result, a predetermined volume of ink 200 corresponding to the distance at which the piston 122A has moved is supplied to the ink tank 10 via the communication path formed by the pipes 152 and 154 and the contact member 114. At this time, since the communication port 12 is closed by the valve 132, the ink 200 does not enter the pipe 146. After a predetermined volume of the ink 200 has been supplied, the valve 134 is closed.

Thereafter, the inside of the ink tank 10 is exposed to the open air (air induction process). Specifically, the three-way valve 130 is changed from the open position between the ports L and C to the open position between the ports R and C to introduce the air from the pipe 140 to the pipe 146. Furthermore, the valve 132 is opened to introduce the air into the ink tank 10 where the pressure is low. After the air has been introduced into the ink tank 10, the valve 132 is closed, and the three-way valve 130 is turned from the open position between the ports R and C to the open position between the ports L and C, so that the original state before the pressure reduction was performed is obtained.

Before the ink filling process is performed, the ink 200 has been already supplied from the ink reservoir 120 to the syringe 122. The supply of the ink 200 from the ink reservoir 120 to the syringe 122 can be performed by retracting the piston 122A by the motor 106 in the direction indicated by an arrow A2 in the state wherein the valve 134 is closed and the valve 136 is opened.

Figure 3:
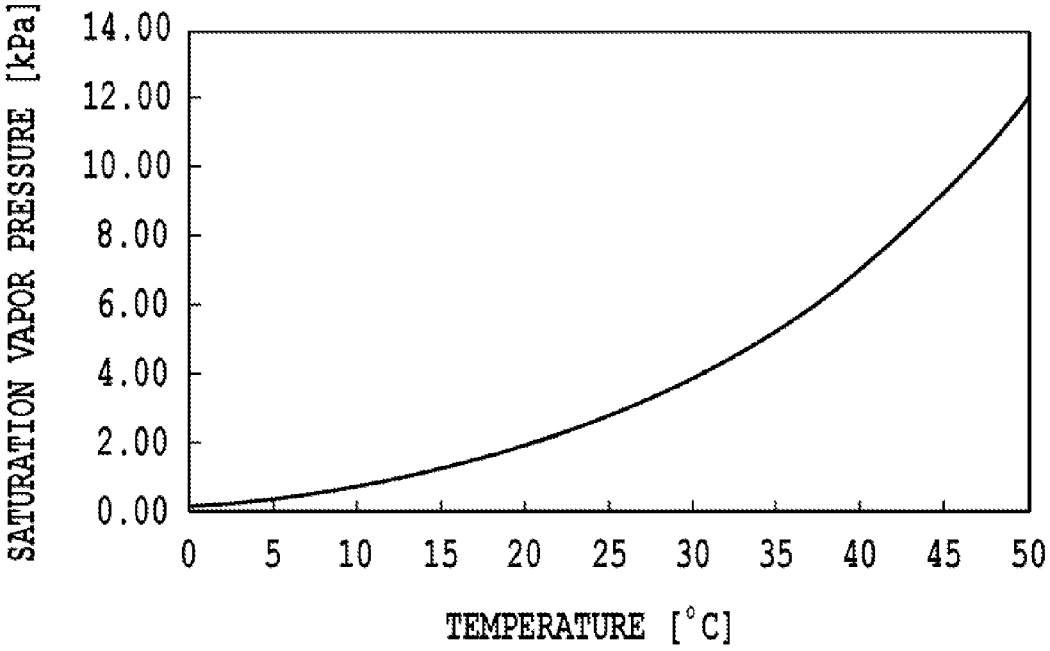
FIG. 3 is a graph for explaining a saturation vapor pressure curve for ink.

It can be anticipated that this ink filling apparatus 900 will be employed to perform sequential filling of a plurality of ink tanks 10. In this case, supply of ink to the first ink tank 10 to be filled is performed, and thereafter, the pressure in the second ink tank 10 is reduced, while ink still remains in the pipe 154 that serves as one part of the ink supply path. When the pressure reduction process is continued, there is a possibility that the ink 200 remaining in the pipe 154 will boil. FIG. 3 is a graph showing the saturation vapor curve for ink, and at the normal temperature of 25° C., saturation vapor pressure is reached at the pressure of ink of 2.7 kPa that is above the target ink pressure of 2 kPa, and as a result, ink boiling occurs. Because of the occurrence of the boiling phenomenon, vapor is saturated in the air that should be discharged during the pressure reduction process, and would hinder the reduction of the pressure in the ink tank 10. When pressure reduction is continued, heat energy required by vaporization of water removes heat from the ink, and as a result, ink is cooled down, so that the saturation vapor pressure is lowered, and the pressure in the ink tank 10 is also reduced. Actually, a desired pressure of 2 kPa can be reached in the long run by continuously reducing the pressure; however, because of the occurrence of a boiling phenomenon, an extended period of time is required for the pressure reduction process until the desired pressure reaches.

In this embodiment of the present invention, based on the above described observation, positive cooling is performed for the residual ink 200 in a space, such as the inside of the pipe 154, where the pressure is to be reduced. When the saturation vapor pressure is reduced as the temperature of ink is lowered, and in a case wherein ink is cooled down at the temperature of, for example, 15° C., the saturation vapor pressure of 1.3 kPa is obtained as shown in FIG. 3, and boiling of ink does not occur until the pressure reaches this level. That is, the pressure of ink can reach the target pressure level of 2 kPa without the occurrence of ink boiling. Therefore, the reduction of the pressure in the ink tank 10 will not be hindered by saturated vapor, and the period required for the pressure reduction process can be shortened.

Characteristic Arrangement for Ink Filling Apparatus

Figure 4:
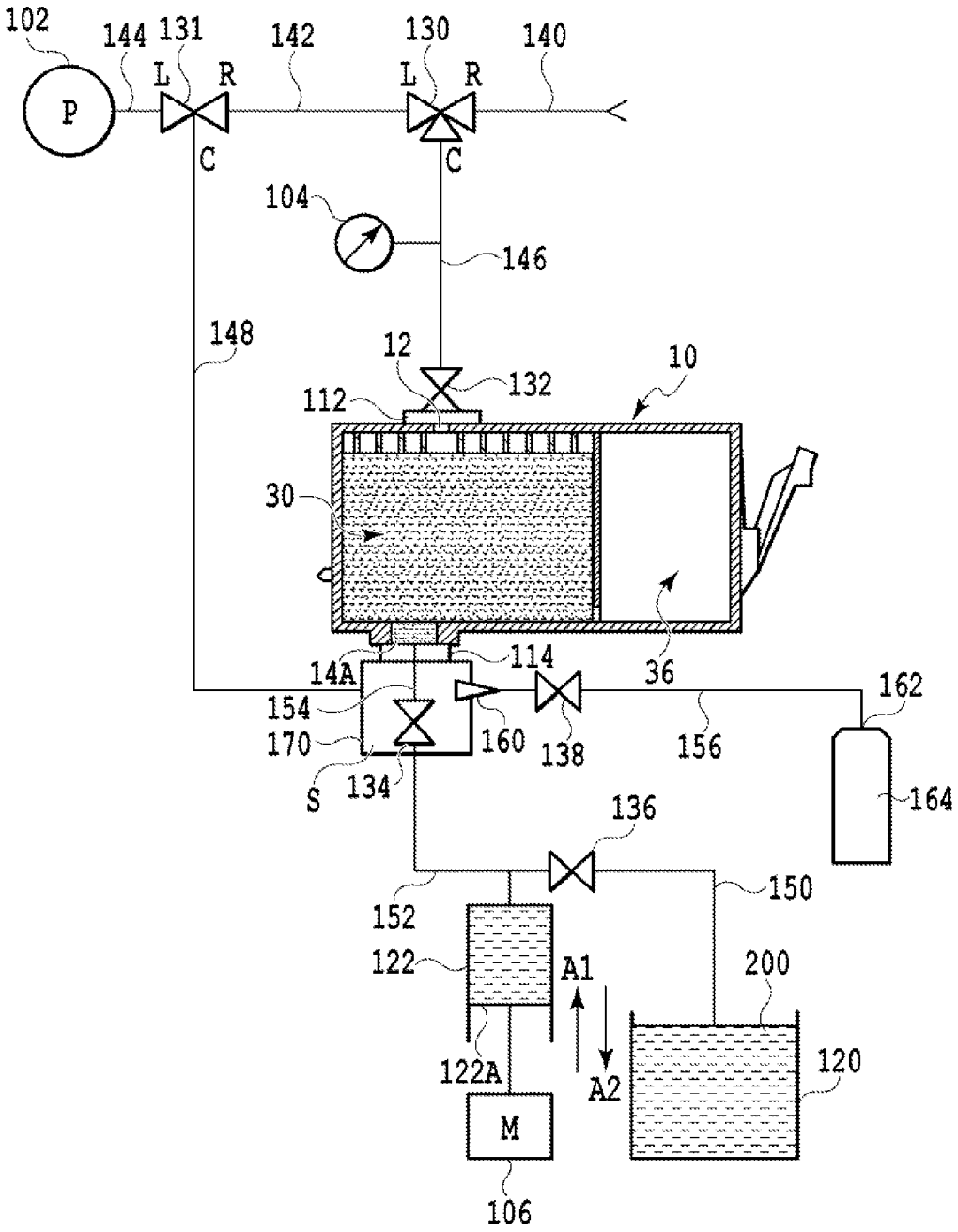
FIG. 4 is a schematic diagram illustrating the arrangement of an ink filling apparatus according to a first embodiment of the present invention.

FIG. 4 is a diagram illustrating the arrangement of the ink filling apparatus for this embodiment that includes an ink cooling function. The same reference numerals as employed in FIG. 2 are provided for the parts that correspond to those in the basic structure in FIG. 2, and no further explanation for them will be given.

A hermetically sealed container 170 where the pipe 154 and the valve 134 are arranged is prepared to cool the inside of the pipe 154. The contact member 114, a pipe 148 and a liquid spray device (liquid spray unit) 160 are arranged to maintain the sealing property of the hermetically sealed container 170. The pipe 148 is connected to a three-way valve 131 located between the vacuum pump 102 and the three-way valve 130. The liquid spray device 160 is connected via a valve 138 and a pipe 156 to a liquid container 162 filled with liquid 164. The liquid spray device 160 is employed to spray the liquid 164 from its distal end toward the pipe 154.

As described above for the ink filling apparatus by referring to FIG. 2, the ink filling apparatus of this embodiment supplies ink to fill the ink tank 10 by performing the pressure reduction process, the filling process and the air induction process. The vacuum pump 102 of the ink filling apparatus in FIG. 2 is operated only for the pressure-reduction process, and the function of the vacuum pump 102 is not employed for extracting an ink tank 10 that has been filled with ink, and for positioning an ink tank 10 that is to be filled. That is, even if the vacuum pump 102 is constantly driven, the vacuum pump 102 will not serve as a negative-pressure supply source during the processes other than the pressure reduction process. In this embodiment, a period during which the function of the vacuum pump 102 is not in use is employed to cool the pipe 154 in the following manner. As for the pressure reduction process, the filling process and the air induction process, the procedures employed in common for those performed by the ink filling apparatus in FIG. 2 will not be explained.

First, in the pressure reduction process, the passageway between the ports L and R of the three-way valve 131 is open to reduce the pressure in the ink tank 10 in the above described manner. Since the reduction of the pressure in the ink tank 10 by employing the vacuum pump 102 is not performed in the filling process and the air induction process, which are to be initiated after the pressure reduction process is completed, the three-way valve 131 is turned from the open position between the ports L and R to the open position between the ports L and C. As a result, the pressure in a low-pressure chamber S provided by the hermetically sealed container 170 is lowered. During reduction of the pressure in the low-pressure chamber S, the liquid 164 is sprayed toward the pipe 154 by the liquid spray device 160 and is attached to the surface of the pipe 154. Since liquid tends to be evaporated in space under reduced pressure, vaporization heat is moved into the air by evaporation of the liquid 164 applied to the surface of the pipe 154, and as a result, the pipe 154 is cooled down, and accordingly, the temperature of the ink 200 inside is reduced. When opening and closing of the valve 138 is controlled to constantly apply the liquid 164 to the surface of the pipe 154, cooling of the ink 200 inside the pipe 154 can be continuously performed. It is appropriate that the liquid 164 should be volatile after having been applied to the surface of the pipe 154. For example, ethanol having a low boiling point can be employed.

Since the cooling operation is performed during the filling process and the air induction process and at the time of extraction of an ink tank 10 and positioning of an ink tank 10, the pressure reduction process for another ink tank 10 can be initiated in the state wherein ink in the pipe 154 is cooled down. As described above, so long as the ink is cooled, the saturation vapor pressure can be lowered, and the period required for the pressure reduction process until the target pressure is reached can be reduced.

In a case wherein sequential supply of ink is performed for filling a plurality of ink tanks 10, the above described processes are repeated. In this case, even when ink remains in the pipe 154 at the beginning of the pressure reduction process, cooling of ink is simply required, so that the period for the pressure reduction process until the target pressure for the ink tank 10 is reached can be reduced, and sequential filling of multiple ink tanks can be efficiently performed.

It is anticipated that depending on some specifications for the vacuum pump 102, drawing of the evaporated liquid 164 to the inside might cause the occurrence of a fault. In such a case, a trap device (not shown) that captures the evaporated liquid 164 can be arranged between the three-way valve 131 and the hermetically sealed container 170. Furthermore, an ink tank to be filled is not limited to the ink tank 10, as shown in FIG. 1, that includes the first and second storage chambers 30 and 36, and supply of ink may also be performed for an ink tank that includes only the first storage chamber 30 in a shorter pressure reduction period.

Second Embodiment

Figure 5:
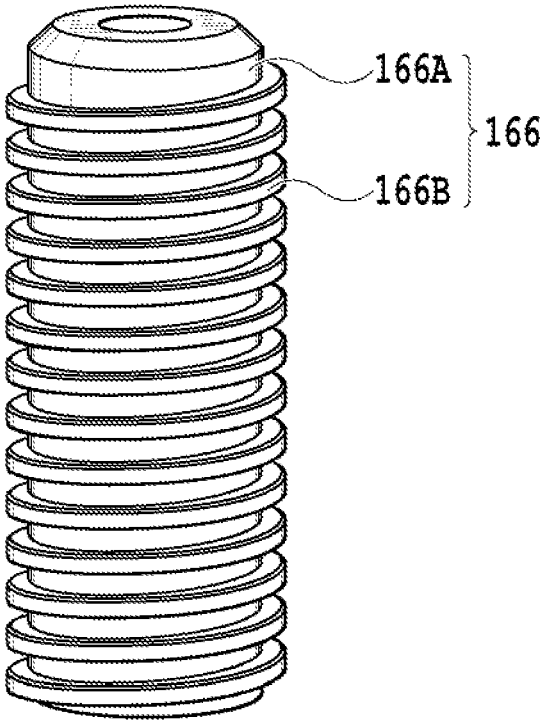
FIG. 5 is a perspective view of a finned pipe according to a second embodiment of the present invention.

In a case wherein for the filling apparatus of the first embodiment, vaporization heat is to be efficiently removed from the surface of the pipe 154 in a limited period of time to cool down the pipe 154, the surface area of the pipe 154 should be increased to vaporize the liquid 164 from the entire surface. Therefore, in a second embodiment of this invention, a finned (helically undulated) pipe 166 shown in FIG. 5 is employed, instead of the pipe 154.

The finned pipe 166 has a shape that a fin 166B is helically arranged on the surface of a hollow pipe body 166A. An appropriate material for the pipe 166 is metal having corrosion resistance for inks and superior thermal conductivity. There are two advantages that the pipe 154 is replaced with the finned pipe 166. One advantage is that the surface area of the pipe 166 can be increased because of the fin 166B, and at the time of evaporation of the liquid, vaporization heat can be easily removed from the pipe 166. The other advantage is that, in a case wherein the liquid is sprayed only in one direction toward the side face of the pipe 166, the liquid can run along the spiral fin 166B and spread across the entire surface of the pipe 166. Therefore, spraying of the liquid need not be performed in multiple directions to apply the liquid to the whole surface of the pipe 166, and only one direction for spraying the liquid is satisfactory, so that the size of the apparatus can be reduced.

Further, the undulated portion of the surface of the pipe 154 is not limited to the helical fin 166B, and may have an arbitrary shape so long as the surface area of the pipe 154 can be increased. A porous material may also be provided for the surface of the pipe 154 to obtain the same effects. This is because the surface area of the pipe 154 can be increased by the presence of the porous material, and due to the capillary action of the porous material, the liquid can be introduced into the entire surface of the pipe 154. So long as the porous state can be obtained for the surface of the pipe 154, the pipe 154 may be formed to have a porous surface, instead of providing the porous material for the surface of the pipe 154.

Third Embodiment

Figure 6:
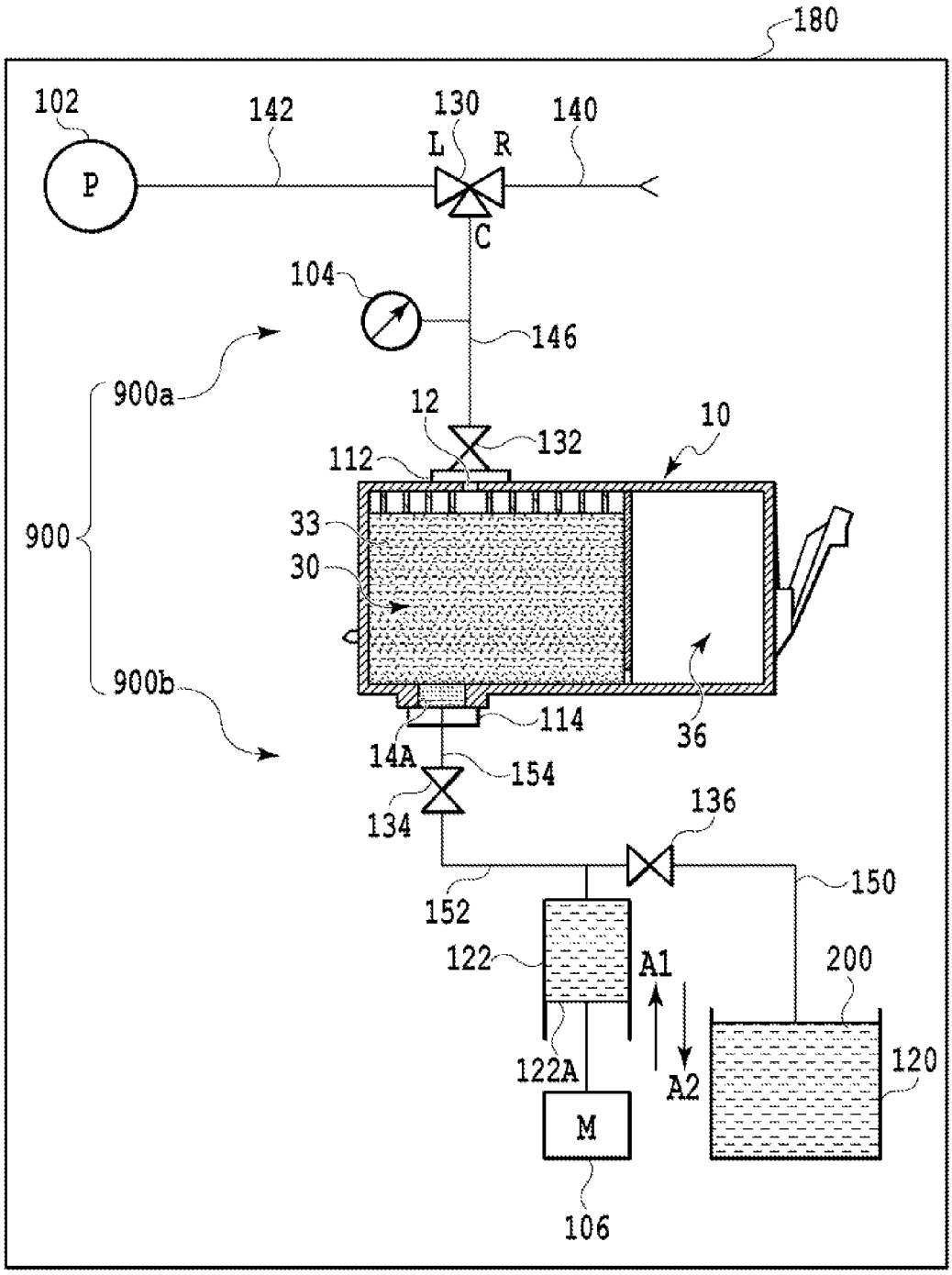
FIG. 6 is a schematic diagram illustrating the arrangement of an ink filling apparatus according to a third embodiment of the present invention.

An ink filling apparatus 900 of a third embodiment of the present invention has an arrangement appropriate for supplying ink to refill an ink tank where ink has been exhausted. The ink filling apparatus 900 of this embodiment will now be described while referring to FIG. 6.

An ink tank 10 that has been used by an ink jet printing apparatus is in the state wherein ink is exhausted in a second storage chamber 36, but ink is still present in an absorber 33 of a first storage chamber 30, and therefore the absorber 33 is damped by ink. In a case wherein supplying of ink is performed in the above described manner to refill the ink tank 10, it is also required that the target pressure in the ink tank 10 be equal to or lower than 2 kPa in order to obtain the regulated volume of air bubble that remains after refilling of ink is completed. However, as apparent from FIG. 3, boiling of ink in the absorber 33 occurs at 2.7 kPa at the normal temperature. When boiling of ink has occurred, the reduction of the pressure in the ink tank 10 is hindered, and the pressure reduction period is extended.

Therefore, according to this embodiment, the whole ink filling apparatus 900 is stored in a low-temperature housing 180 that is maintained at a low temperature to cool down ink that remains in the absorber 33. When ink in the absorber 33 is cooled down in this manner, the saturation vapor pressure of ink can be reduced to delay the occurrence of boiling. Since the target pressure for this embodiment is 2 kPa, it is apparent from FIG. 3 that an appropriate temperature in the low-temperature housing 180 be equal to or lower than 20° C. When refilling of the ink tank 10 is performed in the low-temperature environment provided by the low-temperature housing 180, the pressure of the ink tank 10 can be reduced to the target pressure level without the occurrence of ink boiling during the pressure reduction process. As a result, the period required for pressure reduction can be shortened, and refilling of the ink tank 10 that has been used can be efficiently performed.

Furthermore, generally, in a case wherein the ink-exhausted ink tank 10 is to be refilled, a new ink injection hole must be formed in the second storage chamber 36 of the ink tank 10 in order to refill the second storage chamber 36. However, according to this embodiment, such a processing is not required to refill the ink tank 10.

Other Embodiments

In the arrangements of the above described embodiments, cooling is performed for ink that remains inside the pipe 154 extended between the valve 134 and the ink supply port 14A. However, the cooling process may be performed for ink located in an arbitrary space that communicates with the ink storage chamber so as to be set under reduced pressure, together with the ink storage chamber, and ink to be cooled down is not limited to the ink present inside the pipe 154. Further, a member that defines such an space is not limited to the pipe.

So long as ink in the first storage chamber 30 can be supplied via the ink supply port 14A to the outside, either directly or indirectly, the ink supply port 14A need not be always provided for the first storage chamber 30. The communication port 12 need not also be provided for the first storage chamber 30 so long as the first storage chamber 30 can communicate with the atmosphere via the communication port 12, either directly or indirectly. The communication port 12 in the above embodiments serves as an air communication port, through which the ink tank 10 communicates with the air to supply ink from the ink tank 10 via the ink supply port 14A to an eternal apparatus, such as an ink jet printing apparatus. However, the communication port 12 may be operated only when reduction of the pressure in the ink tank 10 is performed for filling. That is, the communication port 12 may be provided in addition to an air communication port employed to supply ink from the ink tank 10 to an eternal apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-181555, filed Sep. 2, 2013, which is hereby incorporated by reference herein in its entirety.

What is claimed is:

1. An ink filling apparatus, for supplying ink to fill an ink tank that includes an ink storage chamber having a negative-pressure generation member, an ink supply port used to supply ink in the ink storage chamber to an outside, and a communication port through which the ink storage chamber is in fluid communication with the atmosphere, comprising:

a pressure reduction unit configured to reduce pressure in the ink storage chamber to a predetermined pressure through the communication port;

a filling unit configured to supply ink via the ink supply port to fill the ink storage chamber; and a cooling unit configured to cool down the ink present in a space in fluid communication with the ink storage chamber, wherein pressure in the space is reduced by the pressure reduction unit together with pressure in the ink storage chamber, the cooling unit cooling down the ink such that a saturation vapor pressure of the ink is lower than the predetermined pressure.

2. The ink filling apparatus according to claim 1, wherein the filling unit supplies ink from the ink supply port through an ink supply path to fill the ink storage chamber, and the cooling unit cools down ink that is present in a portion of the ink supply path where pressure is to be.

3. The ink filling apparatus according to claim 1, wherein the cooling unit includes a liquid spray portion that sprays liquid to a member that in part forms the space in order to cool down the member.

4. The ink filling apparatus according to claim 3, wherein the liquid spray portion sprays the liquid to a low-pressure chamber where reduction of pressure is performed under a condition where the member is stored.

5. The ink filling apparatus according to claim 4, wherein pressure of the low-pressure chamber is reduced by the pressure reduction unit.

6. The ink filling apparatus according to claim 3, wherein an undulated portion is formed on a surface of the member.

7. The ink filling apparatus according to claim 6, wherein the undulated portion is a helical protrusion.

8. The ink filling apparatus according to claim 3, wherein the member has a porous surface.

9. An ink filling method, for supplying ink to fill an ink tank that includes an ink storage chamber having a negative-pressure generation member, an ink supply port used to supply ink in the ink storage chamber to an outside, and a communication port through which the ink storage chamber is in fluid communication with the atmosphere, comprising:

a pressure reduction step of reducing pressure in the ink storage chamber through the communication port;

a filling step of supplying ink from the ink supply port to the ink storage chamber after the pressure in the ink storage chamber has been reduced at the pressure reduction step;

a cooling step of performing cooling, before the pressure reduction step is to be performed, for ink that is present in a space in fluid communication with the ink storage chamber, wherein pressure in the space is reduced at the pressure reduction step together with pressure in the ink storage chamber.

10. The ink filling method according to claim 9, wherein at the pressure reduction step, a negative pressure is introduced into the ink storage chamber from a negative pressure generation source to reduce the pressure inside, and wherein at the cooling step, liquid for which vaporization heat is employed to cool down a member that in part defines the space is sprayed to a low-pressure chamber where pressure is to be reduced while the member is stored, and the negative pressure is introduced into the low-pressure chamber from the negative pressure generation source during a process other than the pressure reduction step.

11. The ink filling method according to claim 9, wherein the pressure reduction step and the filling step are performed for a first ink tank, and thereafter, the pressure reduction step and the filling step are performed for a second ink tank, and wherein, at least before the pressure reduction step for the second ink tank is initiated, at the cooling step, cooling is performed for ink that remains in the space when the filling step has been completed for the first ink tank.

12. The ink filling method according to claim 9, wherein at the pressure reduction step, the pressure in the ink storage chamber is reduced to a predetermined pressure, and wherein at the cooling step, the ink is cooled down such that a saturation vapor pressure of the ink is lower than the predetermined pressure.

* * * * *